US005211522A

United States Patent [19]

Ho

[11] Patent Number: 5,211,522

[45] Date of Patent: May 18, 1993

[54] PUNCHING AND BINDING MACHINE

[76] Inventor: Jackson Ho, 2nd Fl., No. 5-1, Lane 163, Hsin I Road, Panchiao, Taiwan

[21] Appl. No.: 888,053

[22] Filed: May 26, 1992

[51] Int. Cl.[5] ..... B42B 9/00

[52] U.S. Cl. ..... 412/16; 412/40

[58] Field of Search ..... 412/16, 39, 40; 281/21.1

[56] References Cited

U.S. PATENT DOCUMENTS

| | | | |
|---|---|---|---|
| 3,945,073 | 3/1976 | Adams | 412/39 |
| 4,324,013 | 4/1982 | Wu | 412/16 |
| 4,482,279 | 11/1984 | Jones et al. | 412/39 |
| 4,487,538 | 12/1984 | Jones et al. | 412/39 |
| 4,645,399 | 2/1987 | Scharer | 412/16 |
| 4,820,099 | 4/1989 | Battisti | 412/40 X |
| 4,872,796 | 10/1989 | Hsiesh et al. | 412/40 X |
| 5,059,078 | 10/1991 | Schmid | 412/39 |
| 5,090,859 | 2/1992 | Nanos et al. | 412/40 X |

FOREIGN PATENT DOCUMENTS

| | | | |
|---|---|---|---|
| 2213769 | 8/1989 | United Kingdom | 412/39 |

*Primary Examiner*—Mark Rosenbaum
*Assistant Examiner*—Willmon Fridie, Jr.
*Attorney, Agent, or Firm*—Bacon & Thomas

[57] ABSTRACT

A punching and binding machine, particularly a machine to punch and bind papers at high speed, comprises including a punching unit and a binding unit adapted for independent operation. The punching unit has an upper clamp element and a lower clamp element for use in punching operations and the binding unit incorporates an adjustment mechanism for selecting the use of either an iron binding ring or a plastic binding ring of appropriate diameter for binding of papers of different thicknesses.

6 Claims, 12 Drawing Sheets

PUNCHING AND BINDING MACHINE

BACKGROUND OF THE INVENTION

The present invention relates to a punching and binding machine, particularly a machine to punch and bind papers with a binding ring, especially a plastic binding ring as shown in FIG. 1 or an iron binding ring as shown in FIG. 2.

Generally a punching machine is used solely for punching and an independent binding machine is required for binding of papers. The present invention provides for punching and binding, with iron or plastic binding rings by a single machine. The present invention has the following features:

(1) It can be used with two different types of binding rings: iron binding rings and plastic binding rings;

(2) A stepped slot is used for selecting an iron or plastic binding ring with an appropriate diameter according to the thickness of papers to be bound;

(3) Papers are placed horizontal for punching to assure accurate and easy punching with a minimum space requirement;

(4) Flexibly positioned puncher control rods supported by spring plates assure accurate and easy punching;

(5) A detachable base and operation mechanism for direct punching and binding; and (6) A feeding handle and control lever are fixed with bolts which can be loosen by a coin to facilitate assembly, to minimize packing space and transportation costs.

SUMMARY OF THE INVENTION

The present invention provides a punching and binding machine, particularly a machine to punch and bind papers with a binding ring rapidly. The binding machine comprises a detachable base and operation mechanism including a punching unit and a binding unit for independent operation, in which the punching unit has an upper clamp element and a lower clamp element for punching, the binding unit has a stepped slot for selecting an iron binding ring or a plastic binding ring having a appropriate diameter for binding of papers in different thicknesses.

DETAILED DESCRIPTION OF THE PREFERRED EMBODIMENT

Figure 1:
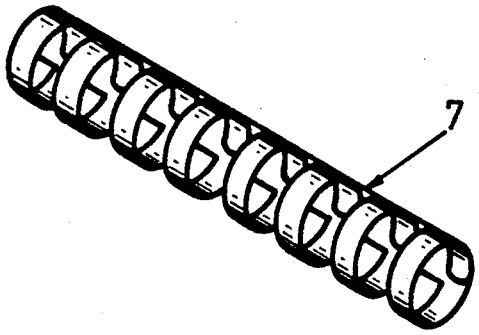
FIG. 1 is a perspective view of a plastic binding ring according to the present invention.
Figure 2:
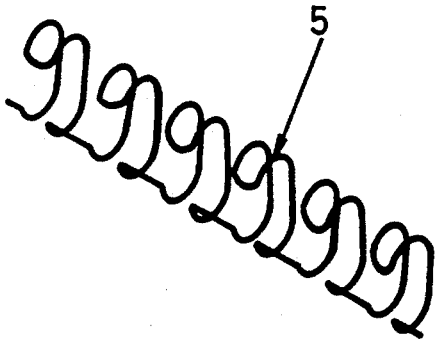
FIG. 2 is a perspective view of an iron binding ring according to the present invention.
Figure 3:
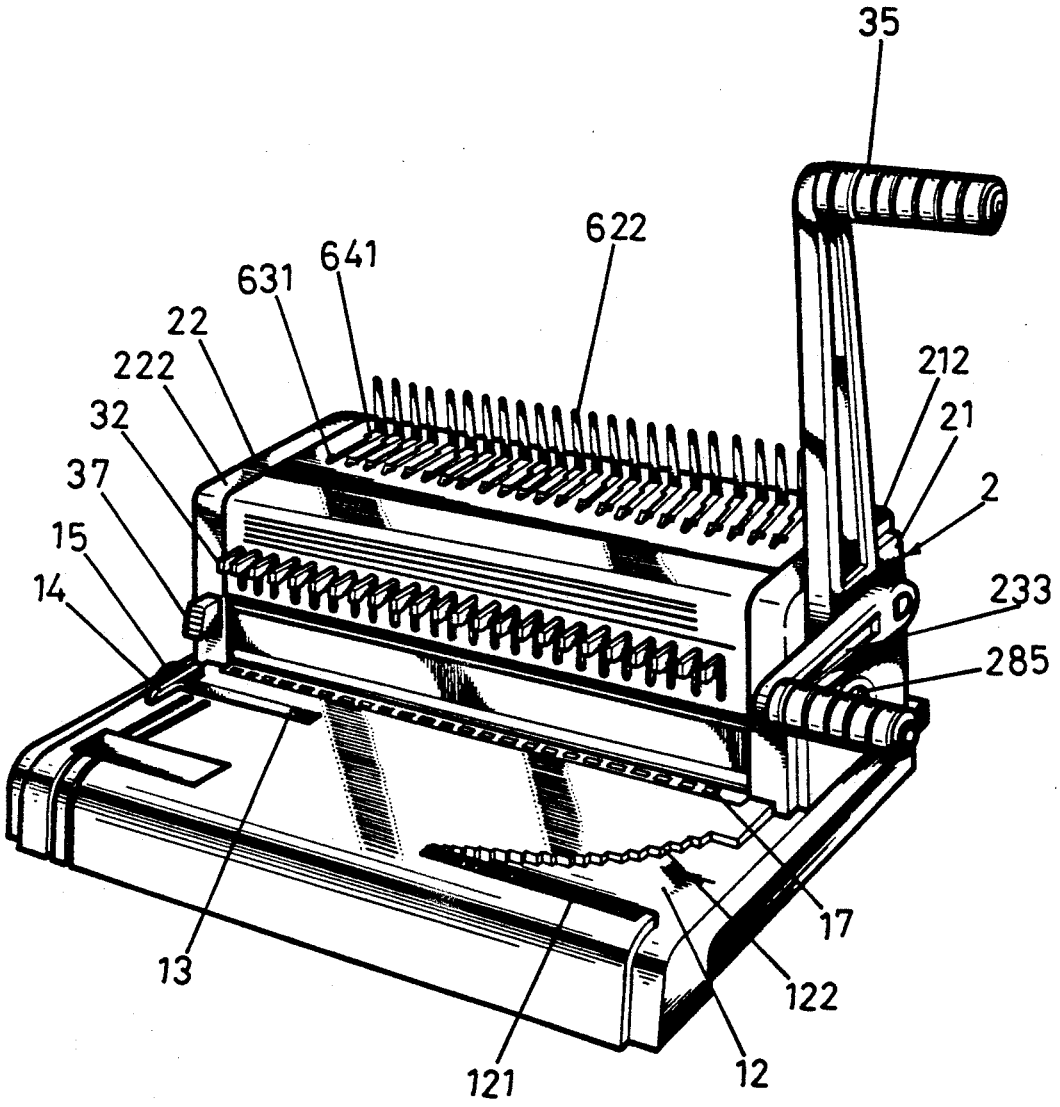
FIG. 3 is a perspective view of a punching and binding machine according to the present invention.
Figure 4:
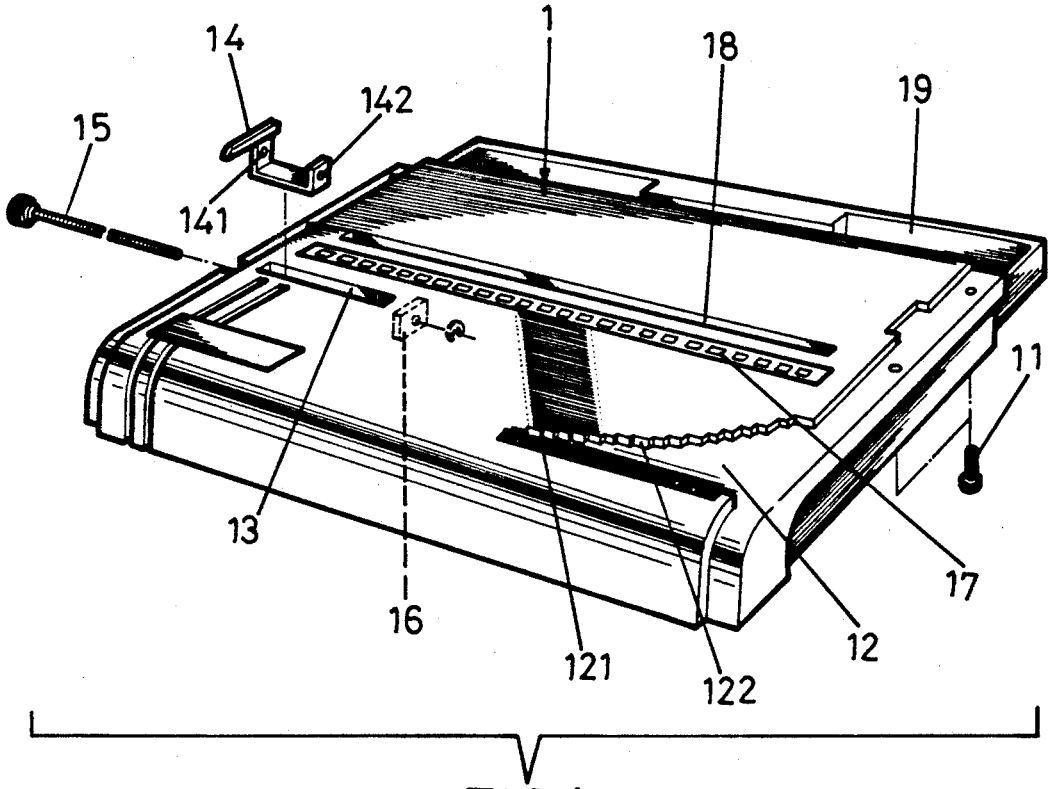
FIG. 4 is a fragmented view of a base for the punching and binding machine according to the present invention.

As shown in FIGS. 3 and 4, the present invention includes a base (1) and an operation mechanism (2). The operation mechanism (2) is fixed to the rear section of the base (1) by means of bolts (11) inserted through the bottom of the base (1). A stepped seat (12) with a plurality of ring number indications (121) and steps (122) is formed on the right front part of the base (1) for selection of iron binding ring (5) (see FIG. 2) and plastic binding ring (7) (see FIG. 1) diameters according to the thickness of papers to be punched and bound. A slot (13) is formed at the left side of the base (1) for holding a positioner (14) which is movably fixed to a support (16) at the bottom of the base (1) by a screw rod (15) passing through two screw holes (141 and 142) formed on the positioner (14) so that the positioner (14) can be displaced leftward and rightward by turning of the screw rod (15) to position papers according to paper size. A plurality of punching marks (17) and a paper dust collecting hole (18) are formed at appropriate locations on the base (1), and a sliding drawer (19) is designed on the back side to collect paper dusts after punching.

Figure 5:
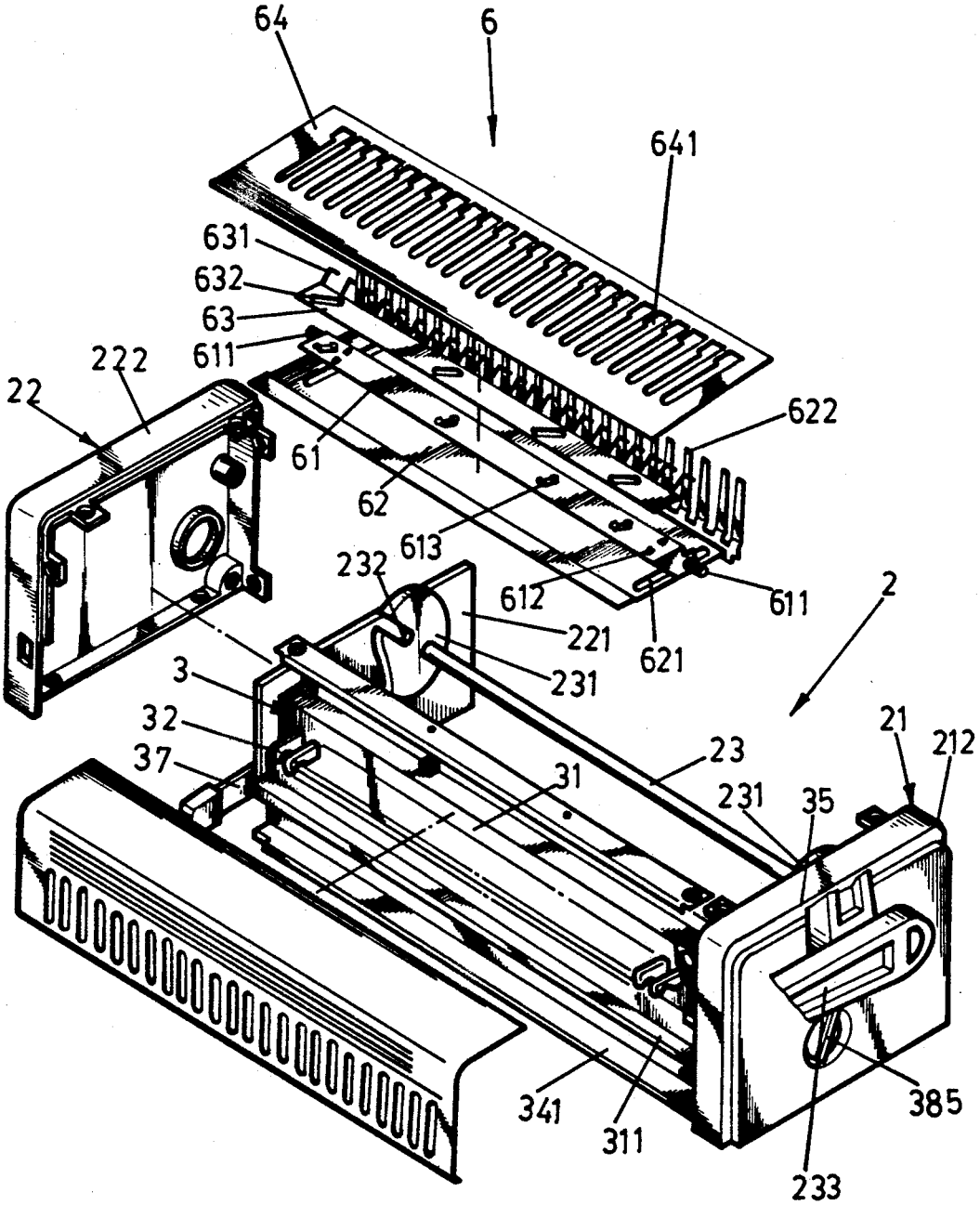
FIG. 5 is a fragmented view of an operating mechanism for the punching and binding machine according to the present invention.

As shown in FIGS. 3 and 5, the operation mechanism (2) has a right fixing block (21) and a left fixing block (22) each comprising a fixing board (221) and an outer casing (222 or 212) arranged symmetrically, a punching unit (3) and a binding unit (6) between the left and right fixing blocks (21 and 22). As shown in FIGS. 3, 5, 6 and 7, the punching unit (3) includes a horizontal seat (31) having a plurality of passing holes (313) each of which is adapted to receive a puncher control rod (32) inserted therein horizontally. Beneath each puncher control rod (32) a positioning spring plate (321) is placed. A puncher (33) is installed below the front end of each puncher control rod (32). The punchers (33) are arranged vertically on a lower block (34) beneath the horizontal seat (31), and each puncher (33) is connected to the horizontal seat (31) by means of a pin (331) so that each puncher (33) can be displaced toward the lower block (34) following the movement of the horizontal seat (31). The lower end of the front side of the horizontal seat (31) is bent so as to define an upper clamp element (311) and the front side of the lower block (34) is bent so as to define a lower clamp element (341). The lower clamp element (341) is fixed, while the upper clamp element (311) can be displaced upward and downward following the movement of the horizontal seat (31). The horizontal seat (31) is mounted within a guide slot (2211) on each fixing board (221) by a side projecting plate (312). A feeding lever (35) is located outside the left fixing block (21). A gear (352) at each side of a feeding rod (351) is engaging with a rack (315) at each end of the horizontal seat (31) in order to displace the horizontal seat (31) downward, and consequently the puncher control rods (32) are displaced downward to cause the respective punchers (33) to punch papers placed below the lower block (34). The punchers (33) are then returned to their original positions by the biasing forces of a spring (314) at each side of the horizontal seat (31). Each of the puncher control rods (32) can be displaced forward or backward and then elastically positioned by the positioning spring plate (321) to maintain contact with, or not contact with, a puncher (33). Therefore, the number of holes to be punched can be controlled. A block (352) is placed below each gear (352) as a stop for upward displacement of the horizontal seat (31) to prevent the feeding lever (35) from ejecting a control handle (233) by tension of the spring (314).

Figure 8:
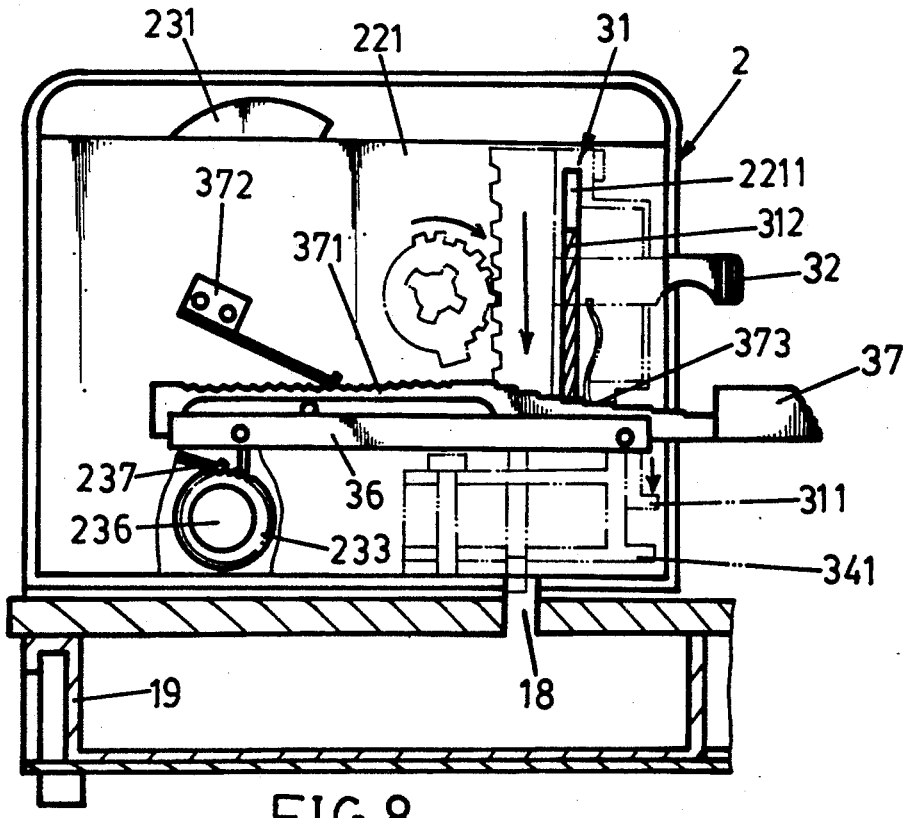
FIG. 8 is another figure illustrating the punching unit in the punching and binding machine according to the present invention.
Figure 9:
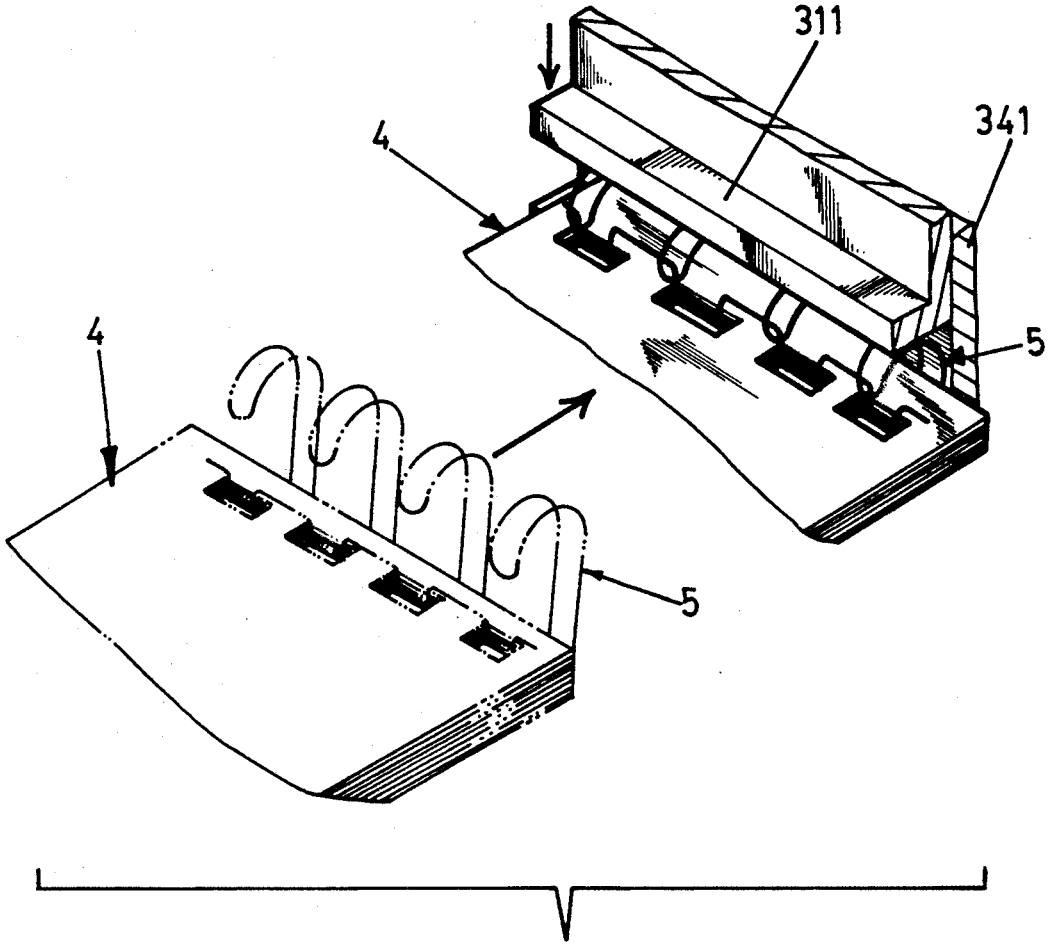
FIG. 9 illustrates the operation of the punching unit with the iron binding ring according to the present invention.

As shown in FIG. 8, the left fixing board (221) has a bent block (36) for installation of a puller (37) having a rack portion (371) at its rear section for positioning with a spring plate (372). The front section of the puller (37) is formed as a stepped rack portion (373) composed of teeth at different heights to contact with the two side projecting plates (312) to control the downward displacement distance of the horizontal seat (31). As shown in FIG. 9, the papers, after punching, can be placed between the upper and lower clamp elements (311 and 341) for binding with the iron binding ring (5) of a suitable diameter.

Figure 6:
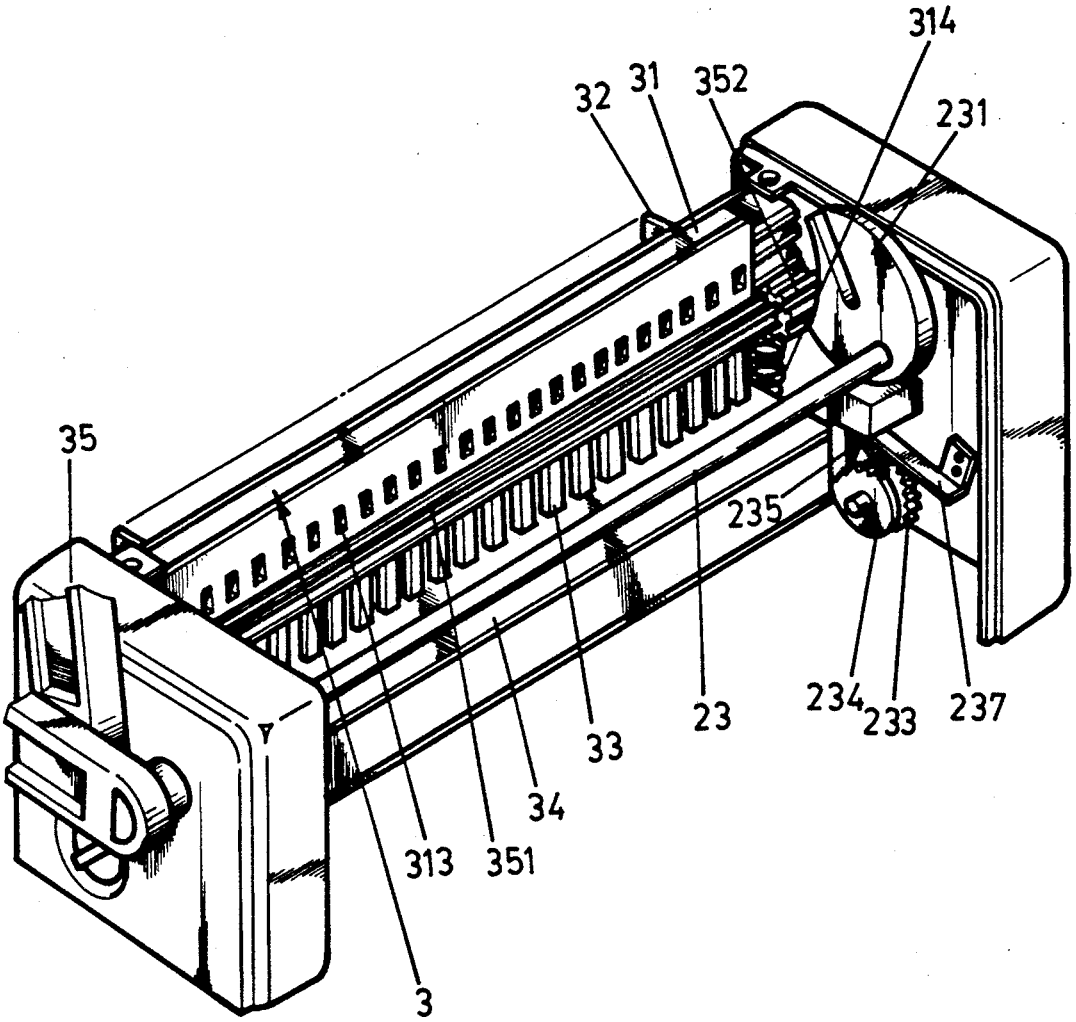
FIG. 6 is a perspective view of an operating mechanism for the punching and binding machine according to the present invention.
Figure 7:
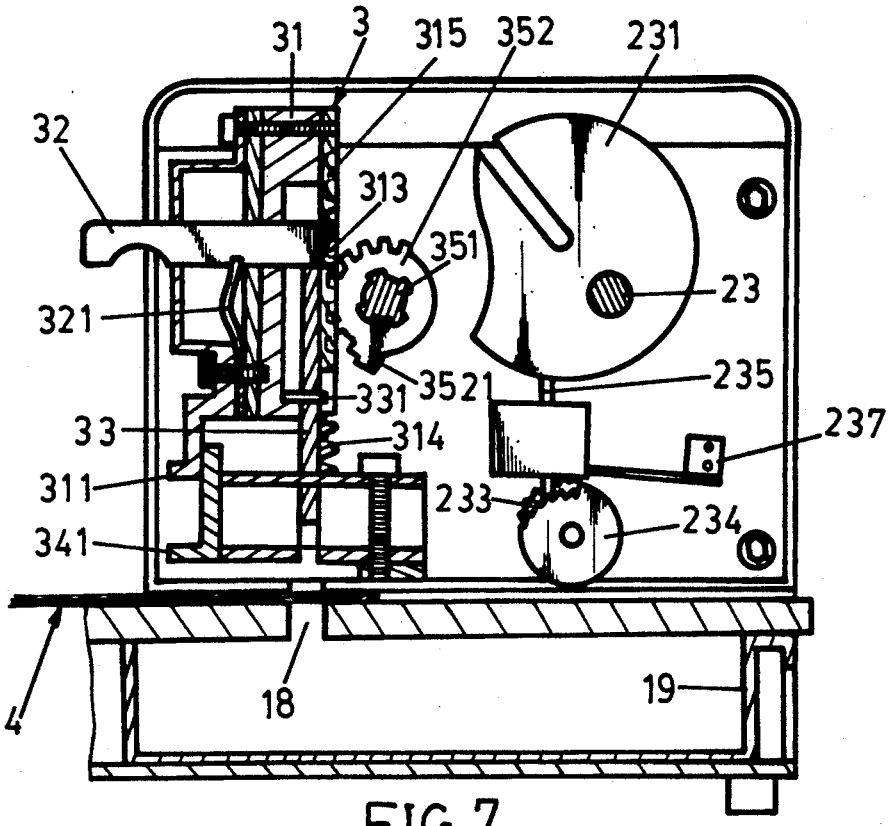
FIG. 7 illustrates the punching unit in the punching and binding machine according to the present invention.
Figure 10:
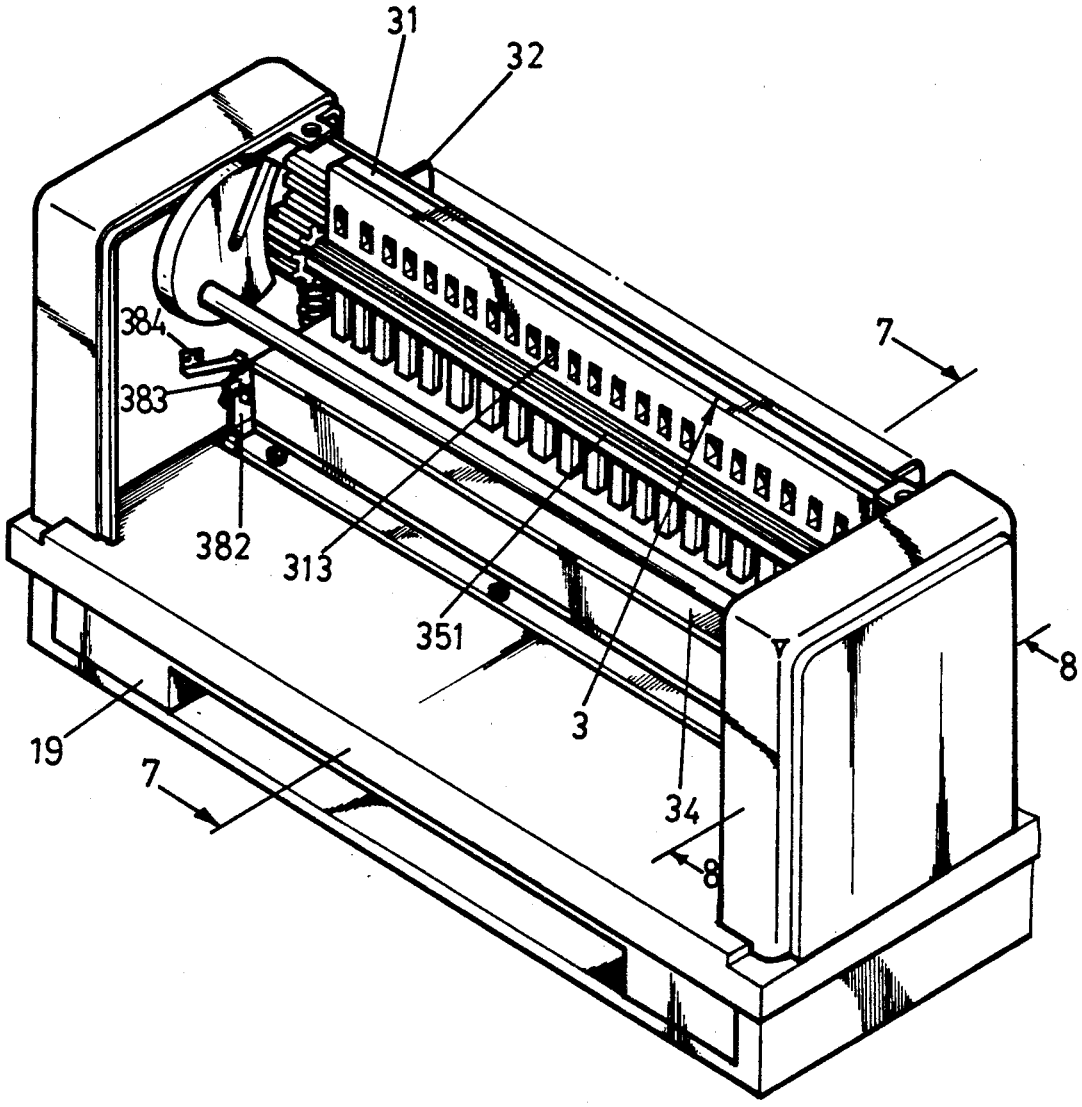
FIG. 10 is a rear perspective view of the punching and binding machine according to the present invention.
Figure 11:
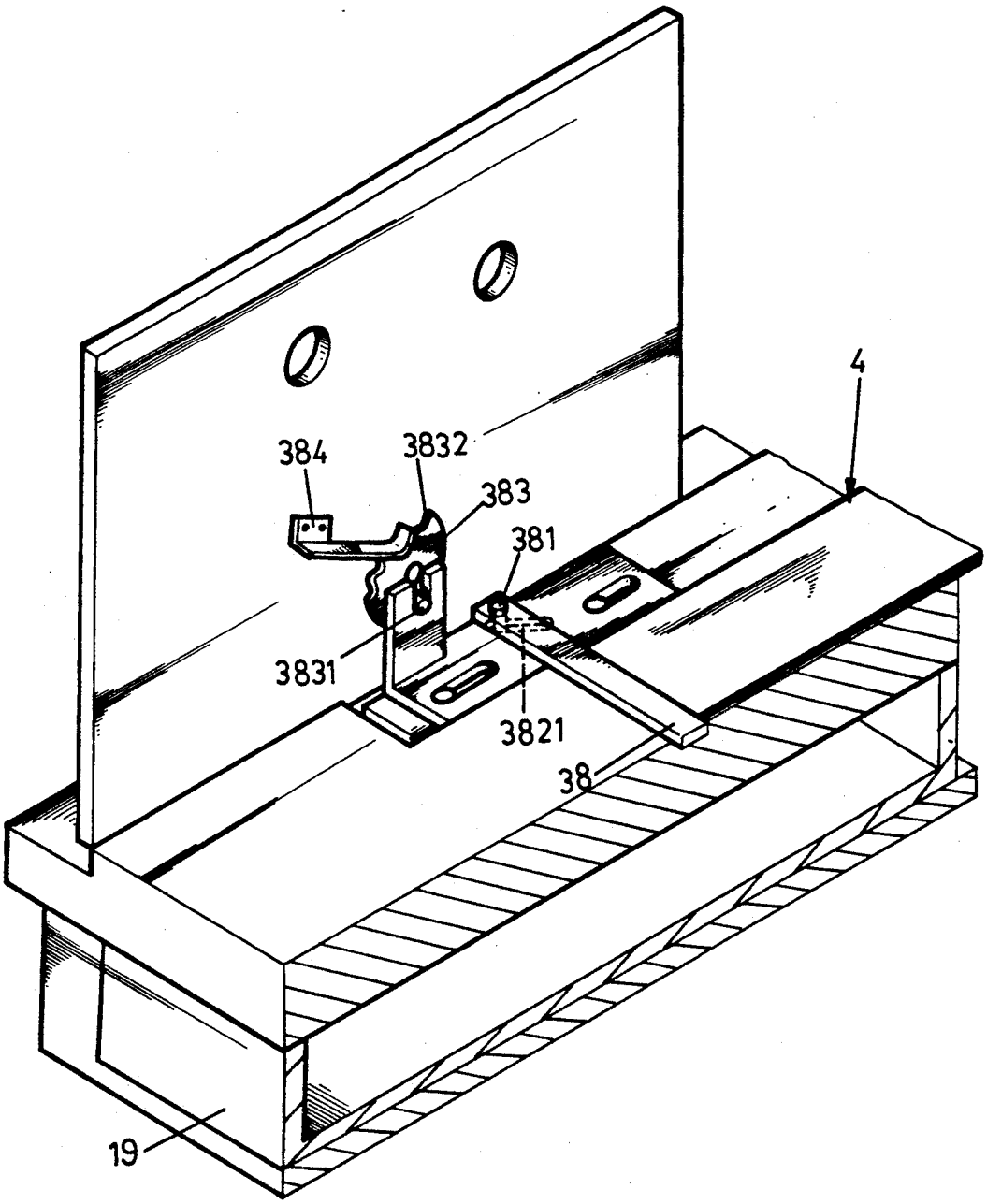
FIG. 11 illustrates a margin control mechanism according to the present invention.

As shown in FIGS. 6, 10 and 11, a traverse stop (38) is designed below the horizontal seat (31). The traverse stop (38) is fixed to a slant slot (3821) of a movable board (382) by means of two pins (381) each at a side. The upper side of the movable board (382) is connected to a post (3831) of a ratchet (383). A plurality of notches (3832) are formed on the upper section of the ratchet (383), and a spring plate (384) is maintained flexibly contacting with one of the notches (3832) so that the ratchet (383) can be turned by a knob (385) accessible from outside the right fixing board (22) in order to displace the movable board (382) forward or backward, and drive the stop (38) to displace forward or backward accordingly. The stop (38) can be positioned at different positions to retain a notch (3832) of the ratchet (383) by the spring plate. The several notches (3832) are designed to displace the stop (38) to several different positions, and then to adjust margins, i.e., the distance between edges of the papers and the location of punching.

Figure 12:
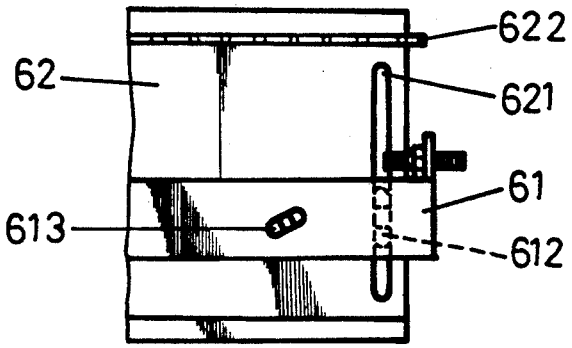
FIG. 12 illustrates a lower board for use and a pulling board in the binding unit according to the present invention.
Figure 13:
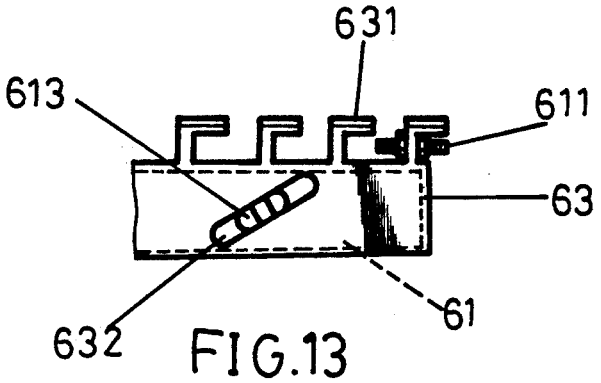
FIG. 13 illustrates a fixing block for shifting rods and a pushing board in the binding unit according to the present invention.
Figure 14:
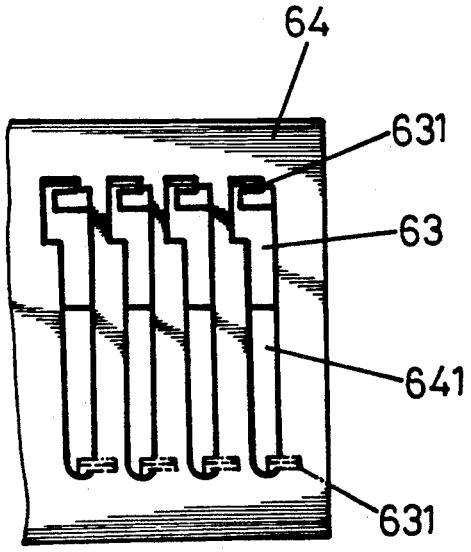
FIG. 14 illustrates the fixing block for the shifting rods and the upper board in the binding unit according to the present invention.
Figure 15:
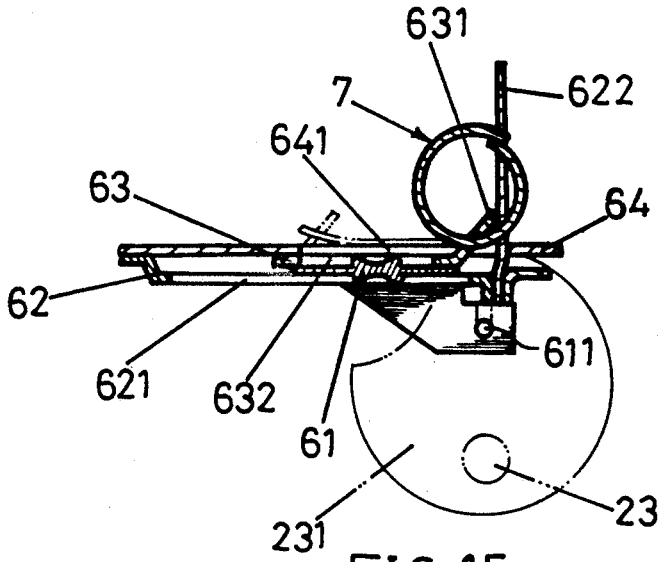
FIG. 15 illustrates the opening of a plastic binding ring with the binding unit according to the present invention.
Figure 16:
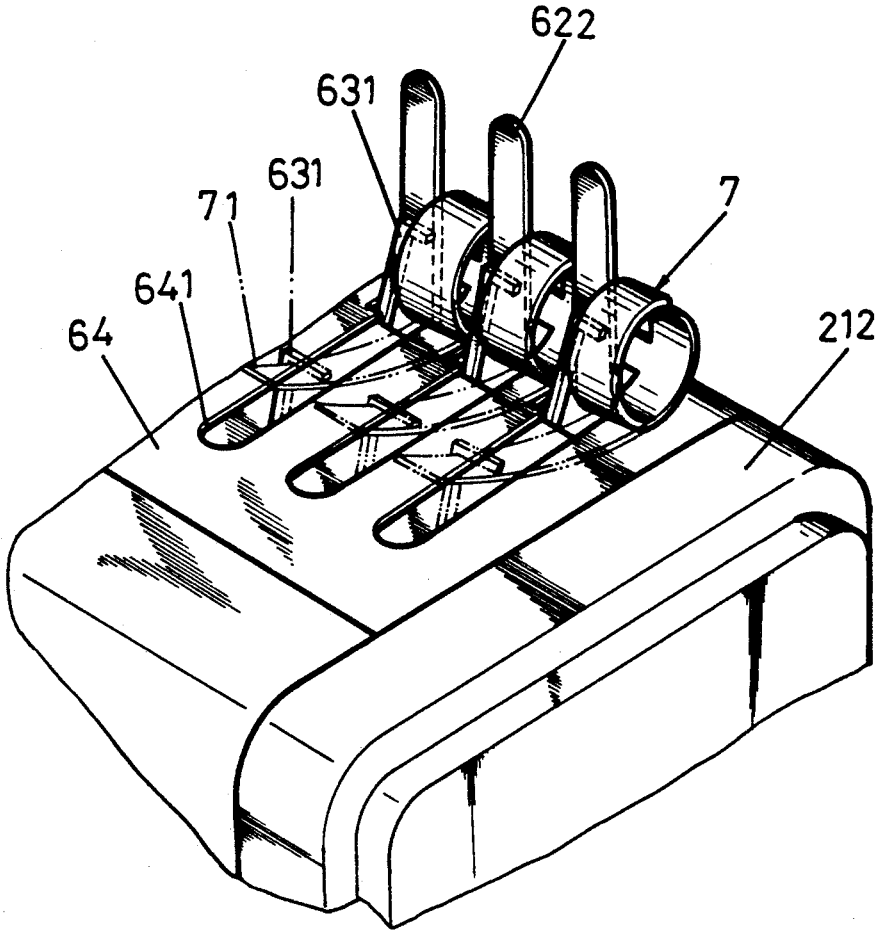
FIG. 16 is another figure illustrating the opening of a plastic binding ring with the binding unit according to the present invention.

As shown in FIG. 5, an eccentric cam (231) is fixed at each end of a link (23). A guide slot (232) is formed on each eccentric cam (231) for fitting of a guide shaft (611) at each side of a pushing board (61) of the binding unit (6). The pushing board (61) has a block (612) at the bottom adapted to slide within a groove (621) at each side of a lower board (62). The front edge of the lower board (62) has a plurality of fixing plates (622) arranged vertically, on which a fixing seat (63) for shifting rods (631) and an upper board (64) are placed in order. The fixing plate (622) and the shifting rods (631) are designed so that they pass through the slots (641) formed on the upper board (64) and extend beyond these slots (641). The fixing seat (63), by rotation of the eccentric cam (231), causes the pushing board (61) to displaced as shown in FIG. 12. With some blocks (613) formed on the pushing board (61) which slide in the slanted slots (632) as shown in FIG. 13, the shifting rods (631) can be displaced forward or backward within the slots (641) of the upper board (64) as shown in FIG. 14. Please refer to FIGS. 15 and 16, the plastic binding ring (7) is placed at the fixing plates (622) of the upper board (64). By shifting of the shifting rods (631), each plastic binding ring (7) is pulled to form an opening at its fixing end (71) so that each fixing end (71) can be inserted to a hole punched in order to bind the papers.

As shown in FIGS. 5, 6, 7 and 8, a gear (233) and a ratchet (234) are located beneath each eccentric cam (231) in parallel. The ratchet (234) incorporates a stop rod (235) to control the degree of rotation of the eccentric cam (231), and consequently to control the range of displacement of the shifting rods (631). A knob (236) is positioned outside the left fixing board (22) to combine with the gear (233) and a spring plate (237) to adjust the stop position so that the shifting rods can be adjusted in their displacement according to diameter of the plastic binding ring (7) used.

Figure 17:
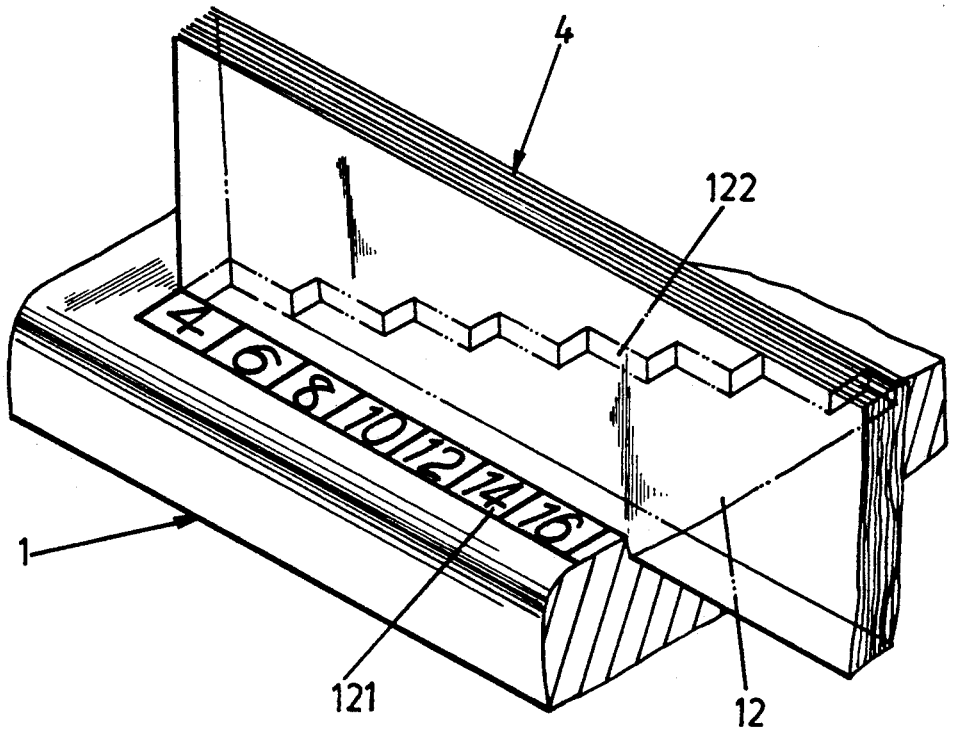
FIG. 17 illustrates a stepped slot on the base according to the present invention.

As shown in FIG. 17, each step (122) of the stepped seat (1) on the base (1) corresponds to a ring number indication (121) for selection of a suitable plastic binding ring (7) according to the thickness of papers to be bound by referring to the ring number indication (121) corresponding to the step (122), and for adjustment of the pulling distance of the puller (37) so that the shifting rods (631) can be correlated with the pulling distance of the plastic binding ring (7).

I claim:

1. A punching and binding machine comprising:

a base having a back section, a stepped seat with a plurality of ring number indications and steps formed on a right front portion thereof, a slot formed at a left side thereof, a positioner movably fixed to a screw rod, a plurality of punching marks and a paper dust collecting drawer;

an operation mechanism removably fixed to the back section of said base, said operation mechanism including a right fixing block and a left fixing block, each of said fixing blocks comprising a fixing board and an outer casing;

a punching unit including a horizontal seat provided with a plurality of passing holes each of which is adapted to receive a puncher control rod inserted horizontally therein, a positioning spring plate located beneath each puncher control rod, a puncher installed below a front end of each puncher control rod for controlling the number of punchers in operation, each of said punchers being arranged vertically on a lower block beneath the horizontal seat and being connected to the horizontal seat by means of a pin so that each puncher can be displaced toward the lower block in response to movement of the horizontal seat, said horizontal seat having a bent lower front end defining a movable upper clamp element, said lower block having a bent front side defining a fixed lower clamp element which is adapted to be engaged by the lower front end of the movable upper clamp element upon upward and downward movement of the horizontal seat, said horizontal seat being mounted within a guide slot formed in each of said fixing boards by a respective side projecting plate and by a feeding lever movably mounted outside the left fixing block which is connected to a gear at each side of a feeding rod, said feeding rod being engaged with a rack at each end of the horizontal seat in order to cause displacement of the horizontal seat downward by moving said feeding lever, and consequently shifting the puncher control rods downward to cause the respective punchers to punch papers placed below the lower block, said punchers are then returned to their original positions under the force of a spring positioned at each side of the horizontal seat; and a binding unit including a plurality of shifting rods carried by a fixing seat, a lower board, a pushing board upon which said fixing seat is mounted and an upper board, said upper and lower boards being fixed to the left and right fixing blocks of the operation mechanism respectively, said binding unit being driven by eccentric cams each of which is carried by the operation mechanism and is formed with a guide slot for receiving a respective end of a guide rod secured to said pushing board such that rotation of said cams causes shifting of said pushing board and displacement of said fixing seat and shifting rods.

2. A punching and binding machine as claimed in claim 1, wherein the front end of each puncher control rod in the punching unit is kept in contact with a respective puncher to move the puncher forward in response to downward displacement of the horizontal seat, and a positioning spring plate is positioned below each puncher control rod to flexibly support the puncher control rod.

3. A punching and binding machine as claimed in claim 1, wherein the left fixing board of the operation mechanism has a bent block for installation of a puller having a rack portion at a rear section thereof for positioning with a spring plate, and a front section of the puller is formed as a stepped rack portion composed of teeth at different heights which are adapt to be placed in contact with the two side projecting plates of said punching unit to control the permissible downward displacement distance of the horizontal seat.

4. A punching and binding machine as claimed in claim 1, further comprising a gear and ratchet mechanism located beneath at least the eccentric cam at the left fixing block of the operation mechanism said gear and ratchet mechanism incorporating a stop rod means for controlling the degree of rotation of the eccentric cam, and consequently the range of displacement of the shifting rods.

5. A punching and binding machine as claimed in claim 1, wherein the lower board of said binding unit is formed with a plurality of fixing plates and the upper board is formed with a plurality of slots through which said fixing plates extend, the upper and lower boards being positioned on the left and right fixing blocks of the operation mechanism, and the pushing board is formed with a plurality of blocks which are slidably mounted in slanted slots formed in the fixing seat.

6. A punching and binding machine as claimed in claim 1, wherein a traverse stop is provided below the horizontal seat, the traverse stop is fixed to a slant slot of a movable board by means of two pins, an upper side of the movable board is connected to a post of a ratchet, a plurality of notches are formed on an upper section of the ratchet, and a spring plate engages one of the notches, said ratchet being attached to a knob located outside the right fixing board such that rotation of said ratchet by said knob displaces the movable board forward or backward and drives the stop, against which an edge of papers to be punched are adapted to be placed, to displace forward or backward accordingly so as to adjust the distance between said stop and the location of punching.

* * * * *